United States Patent [19]

Morimoto et al.

[11] Patent Number: 4,766,526

[45] Date of Patent: Aug. 23, 1988

[54] LIGHT SOURCE

[75] Inventors: Kiyoshi Morimoto; Hitoshi Toki, both of Mobara, Japan

[73] Assignee: Futaba Denshi Kogyo Kabushiki Kaisha, Mobara, Japan

[21] Appl. No.: 882,402

[22] Filed: Jul. 7, 1986

[30] Foreign Application Priority Data

Jul. 15, 1985 [JP] Japan ..... 60-156290

[51] Int. Cl.[4] ..... F21M 3/14; F21V 7/00

[52] U.S. Cl. ..... 362/255; 362/257; 362/293; 362/296; 362/300; 362/317

[58] Field of Search ..... 362/293, 307, 311, 317, 362/326, 327, 351, 2, 16, 84, 260, 255, 293, 296, 300, 305, 257; 313/485, 113, 486, 487, 578, 489, 315, 569, 579, 580

[56] References Cited

U.S. PATENT DOCUMENTS

| | | | |
|---|---|---|---|
| 2,103,029 | 12/1937 | Davies | 362/260 |
| 2,176,151 | 10/1939 | Rüttenauer | 313/487 |
| 3,527,974 | 9/1970 | Cooper | 313/113 |
| 3,619,695 | 11/1971 | Nameda | 313/113 X |
| 3,712,980 | 1/1973 | Norton | 362/260 |
| 4,047,069 | 9/1977 | Akutsu et al. | 313/486 X |
| 4,315,186 | 2/1982 | Hirano et al. | 313/113 X |
| 4,366,407 | 12/1982 | Walsh | 362/255 X |

*Primary Examiner*—Larry Jones

*Attorney, Agent, or Firm*—Oblon, Fisher, Spivak, McClelland & Maier

[57] ABSTRACT

A light source which is capable of improving lightening efficiency is disclosed. The light source includes a phosphor layer provided at a part of a filter arranged adjacent to a light emitting lamp or arranged so as to serve as a reflection layer so that it may transmit light of the lamp required and be excited by a part of light of the lamp to emit light of a visible region to increase the intensity of light discharged from the light source.

9 Claims, 3 Drawing Sheets

LIGHT SOURCE

BACKGROUND OF THE INVENTION

1. Field of the Invention

This invention relates to a light source for emitting light of a long wavelength for use in stage lighting, an auxiliary lamp of a vehicle or the like, and more particularly to a light source which is improved in luminous efficacy or lightening efficiency.

2. Description of the Prior Art

A fog lamp is provided as one of auxiliary lamps for an automobile. The fog lamp is lightened to emit light far in the distance at the occurrence of fog which absorbs and disturbs headlights so as to ensure safety driving.

The fog lamp emits light of a long wavelength exhibiting a luminous color of yellowish green or yellow in order to prevent light from being absorbed in fog or the like. For this purpose, the fog lamp generally employs a combination of a tungsten lamp and a filter to cut light of a short wavelength emitted from the lamp and obtain light of, for example, yellow luminous color.

In FIG. 9, the curve (a) shows a spectral distribution of a tungsten halogen lamp which is generally called a halogen lamp. When the halogen lamp is combined with a filter having spectral transmittance characteristics as indicated at the curve (b) in FIG. 9 light of yellow to red luminous color is obtained. This concept has been utilized in various kinds of lamps, such as, for example, a road lamp, a directional indication lamp, a stop lamp and a tail lamp for an automobile, a stage lighting lamp, and the like.

When a filter is used to obtain light of desired luminous color, light of a wavelength deviated from the transmission region of the filter is cut as exemplified by the halogen lamp shown in FIG. 9. In FIG. 9, the curve (b) indicates transmission characteristics of a filter combined with a halogen lamp light in a zone A indicated at oblique lines in FIG. 9 is absorbed in the filter and converted into useless heat within the filter, and energy in the zone (A) is wasted in vain.

SUMMARY OF THE INVENTION

The present invention has been made in view of the foregoing disadvantage of the prior art.

It is an object of the present invention to provide a light source which is capable of efficiently utilizing energy of light which has been conventionally absorbed in a filter and disused, to thereby totally increase the intensity of light outwardly discharged therefrom.

Due to the recent development of a luminescent material, photoluminescence phosphors exhibiting luminescence by light excitation, for example, phosphors emitting light of a wavelength within a visible region under excitation of visible light have been put into practice. These phosphors includes fluorescent dyestuff used for the dyeing of fiber, fluorescent pigment used as paint exhibiting luminous color under daylight circumstances, and the like.

The present invention is based on the utilization of such a phosphor. In accordance with the present invention, there is provided a light source which comprises a light emitting lamp and a filter. The filter is arranged adjacent to the lamp and is formed of phosphor which emits light of a visible region under excitation of visible light so that a portion of light emitted from the lamp which has conventionally no use may be utilized as stimulus light, to thereby improve the intensity of lightening of the light source.

BRIEF DESCRIPTION OF THE DRAWINGS

These and other objects and many of the attendant advantages of the present invention will be readily appreciated as the same becomes better understood by reference to the following detailed description when considered in connection with the accompanying drawings in which like reference characters designate like or corresponding parts throughout; wherein.

DETAILED DESCRIPTION OF THE PREFERRED EMBODIMENTS

Now, a light source according to the present invention will be described hereinafter with reference to the accompanying drawings.

First, phosphor used in a light source of the present invention will be described.

Figure 6:
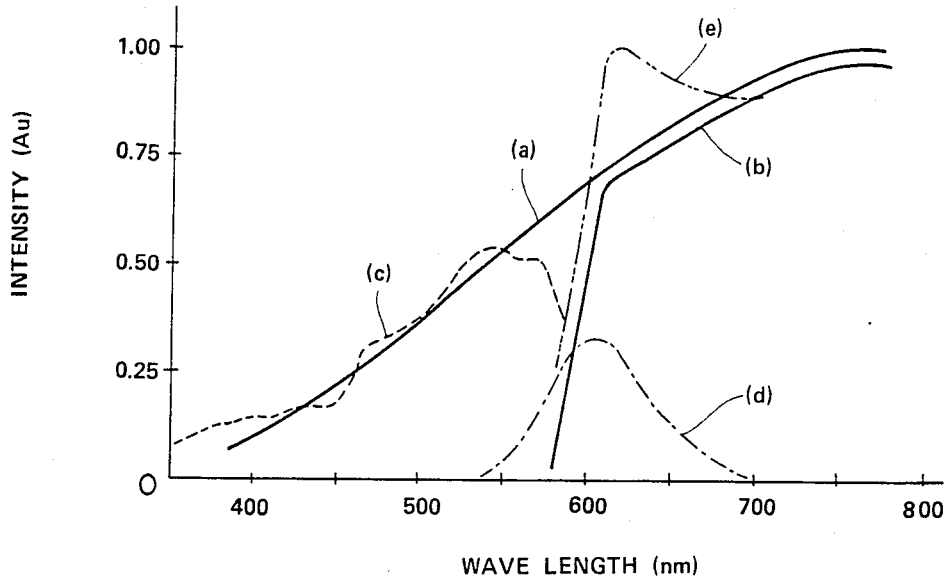
FIGS. 6 and 7 each are a graphical representation showing the operational characteristics of a light source according to the present invention.

FIG. 6 shows the operational characteristics of a light source increasing in lightening intensity according to the present invention. In FIG. 6, the axis of abscissas indicates a wavelength of light (nm) and the axis of ordinates the intensity of light.

In FIG. 6, the curve (a) indicates a spectral distribution of a halogen lamp, and the curve (b) indicates a spectral distribution of transmission light obtained by passing light of the halogen lamp through a filter which is capable of transmitting light of a wavelength above about 600 nm with transmittance of about 90% for use in a fog lamp. The fog lamp is required to outwardly discharge light of a relatively long wavelength which is not absorbed in fog, rain or the like. Accordingly, light emitted from the halogen lamp is treated by the filter so that orange-colored light having a spectral distribution indicated at the curve (b) may be discharged through the filter.

The curve (c) in FIG. 6 indicates an excitation spectrum of phosphor arranged adjacent to the halogen lamp. The phosphor used is organic phosphor manufactured and sold by Shinroihi Kabushiki Kaisha under the designation FM-16 Orange Yellow, which is excited with light having a wavelength of 400–600 nm. The excitation of the phosphor emits visible light having a peak at 600 nm as indicated at the curve (d) of dashed lines in FIG. 6. This indicates that the organic phosphor converts light of a wavelength below 580 nm which is cut by a filter into light of 550–700 nm. As a result, light outwardly discharged through the filter may be correspondingly increased in intensity. In other words, light outwardly discharged through the filter corresponds to the sum of transmission light which has passed through the filter or a transmission component and light converted by the phosphor or a phosphor depending component, as indicated at the curve (e) of two-dot chain lines in FIG. 6.

Figure 7:
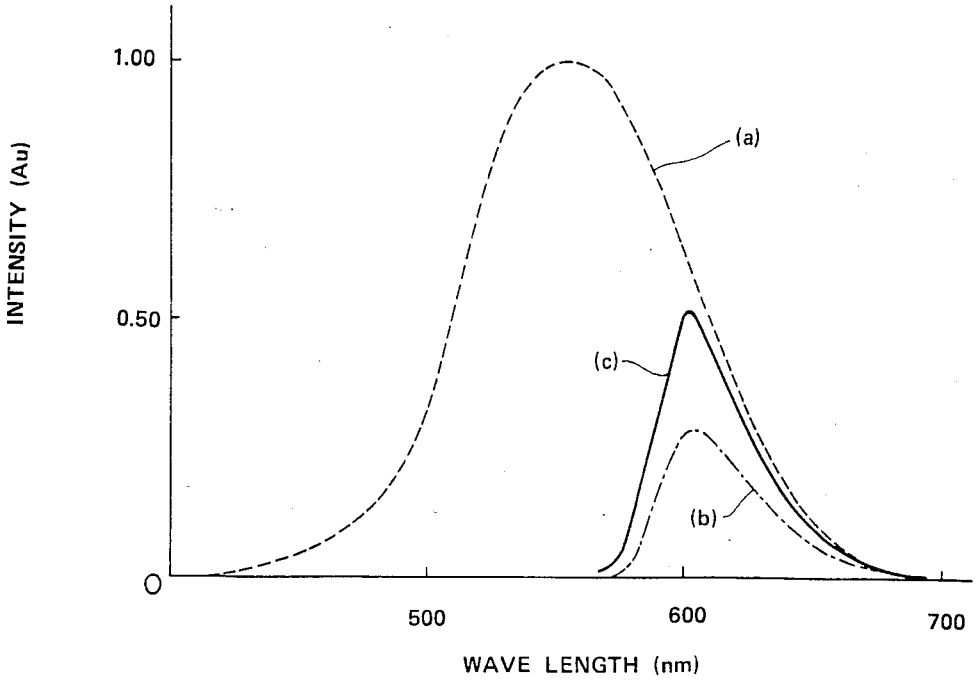

FIG. 7 shows a variation in brightness of light which is actually sensed by an observer when the phosphor depending component is superposed on the transmission component.

The curve (a) of dotted lines in FIG. 7 indicates that spectral luminous efficiency obtained at a bright place (a lamp is lightened at a bright environment). Brightness of light sensed by human eyes is proportional to the product of spectral emission intensity (spectral intensity of light which is actually incident on human eyes as indicated by the curves (b) and (e) in FIG. 6) and spectral luminous efficiency curve (a). The correction of the phosphor depending component indicated at the curve (b) of dashed lines in FIG. 7 (corresponding to light emitted from the excited organic phosphor and indicated at the curve (d) in FIG. 6) to the intensity of light actually sensed by human eyes based on the spectral luminous efficiency curve (a) forms the curve (c) indicated at a solid line in FIG. 7.

In general, the measurement of light is carried out by either radiometry or photometry. Radiometry is to measure incident light of a measuring object by means of a sensor having flat spectral sensitivity characteristics, and a value measured is represented by a unit W. Photometry is to measure visible light or light having a wavelength of 380–750 nm and is carried out by means of a sensor having spectral characteristics approaching to average spectral luminous efficacy of human eyes. Accordingly, the estimation of intensity of light measured by radiometry as brightness actually observed by human eyes requires to take spectral sensitivity characteristics of human eyes into consideration. For example, this is carried out by multiplying a measured value of light of each wavelength due to radiometry by spectral luminous efficacy of human eyes. The characteristics thus obtained are indicated at the curve (c) in FIG. 7 which corresponds to bright actually sensed by human eyes. This is equivalent to the curve (e) in FIG. 6. The sum of transmission light passing through the filter to which phosphorescence is added as indicated at the curve (e) in FIG. 6 is sensed by human eyes far more brighter than the light solely passing through the short wavelength cut filter.

Light excited phosphor absorbs light of a short wavelength and transfers the absorbed light into light of a long wavelength to be emitted. In this instance, a wavelength region of incident light which causes the light to be efficiently transferred into light of a long wavelength is varied depending upon phosphor. Accordingly, it is required to select desired phosphor in view of the purpose for use or depending upon light of a wavelength required.

Organic phosphor which may be used for such a light source as a fog lamp includes a rhodamine 6G known as fluorescent dye which emits yellow to orange-colored light due to light excitation, rhodamine B which emits orange-colored to red light and the like other than that described above.

Inorganic phosphor suitable for use includes $(Zn_{1-x}Cd_x)S:Ag,A1$ which emits light of yellowish green to red luminous color due to light excitation when a mixed crystal ratio x is determined to be within a range of 0.3–1, $(Zn_{1-x}Cd_x)S:Au,A1$ which emits light of yellowish green to red luminous color due to light emission when the mixed crystal ratio x is determined to be within a range of 0–0.6, $SnO_2:Eu$ which emits orange-colored light, ZnS:Mn which emits yellowish orange-colored light, and the like.

Now, embodiments of a light source according to the present invention which are respectively shown in FIGS. 1 to 5 will be described hereinafter.

Figure 1:
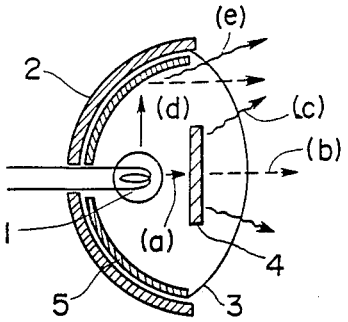
FIGS. 1 to 5 are schematic views showing embodiments of a light source according to the present invention, respectively.

In an embodiment illustrated in FIG. 1, a light source includes a lamp 1 such as, for example, a halogen lamp, a lamp holder 2 which receives the lamp 1 therein and acts also as a reflection plate, and a cover glass 3. Reference numeral 4 indicates a fluorescent filter which constitutes one of features of the present invention.

Figure 8:
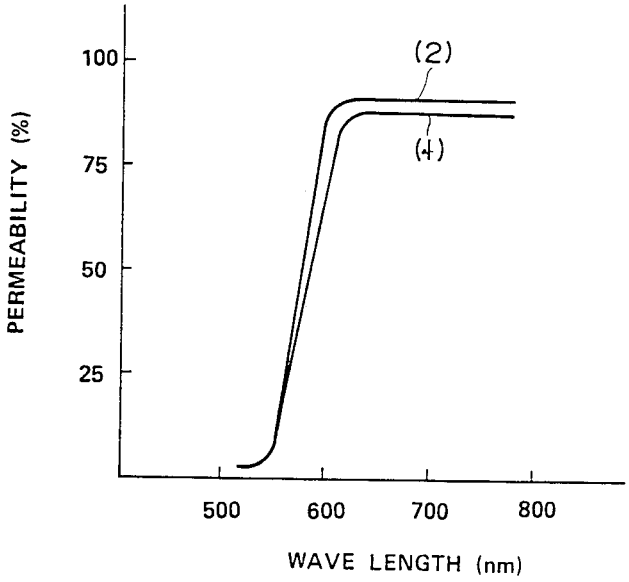
FIG. 8 is a graphical representation showing transmission characteristics of phosphor used in an embodiment of a light source according to the present invention.
Figure 9:
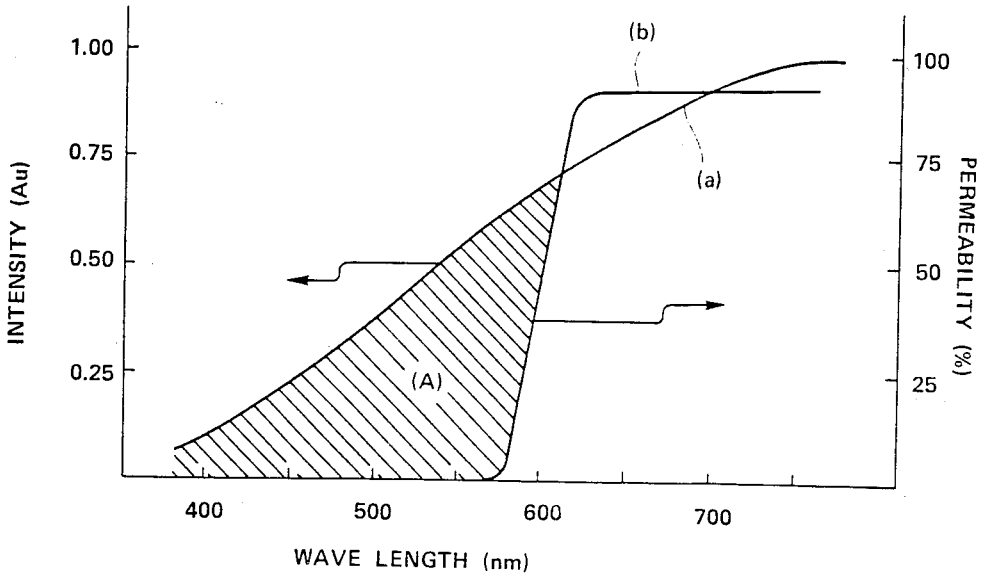
FIG. 9 (PRIOR ART)
FIG. 9 is a graphical representation indicating a disadvantage encountered with a conventional light source equipped with a filter.

The fluorescent filter 4 may be formed, for example, by dissolving, in acetone, phosphor such as organic phosphor manufactured and sold by Shinroihi Kabushiki Kaisha under the designation FM-16 Orange Yellow, coating the dissolved phosphor on a light-permeable substrate such as a glass plate, and drying on the phosphor-coated substrate to vaporize acetone. The filter thus formed has transmission characteristics as indicated at the curve (1) in FIG. 8. For comparison, the transmission characteristics of a commercially available filter which is manufactured and sold by Kabushiki Kaisha Toshiba under the designation 0–57 and is adapted to pass yellowish orange-colored light therethrough are indicated at the curve (2) in FIG. 8. FIG. 8 indicates that the fluorescent filter 4 used in the illustrated embodiment is somewhat inferior in transmittance to the conventional filter. This is to be understood that the transmittance is substantially affected by the thickness of the filter substrate or glass plate, the thickness of the phosphor layer and the like. The fluorescent filter having transmission characteristics equal to the conventional filter can be formed by suitably determining such factors. The fluorescent filter 4, as clearly noted from FIG. 8, transmits light of a long wavelength above about 550 nm and is excited by light of a short wavelength so as to emit light of a long wavelength above 550 nm, as in the curve (c) in FIG. 6 described above.

Accordingly, light of the halogen lamp 1 observed through the fluorescent filter 4 comprises the sum of transmission light passing through the filter and phosphor depending light emitted by the filter.

The halogen lamp 1, as shown in FIG. 6, has a wide spectral distribution extending from about 400 nm to an infrared region. Accordingly, light observed through the fluorescent filter 4 is increased in intensity by light emitted from the filter due to the filter treatment, as in the curve (e) in FIG. 6 described above.

Also, in the embodiment shown in FIG. 1, a layer 5 of the same phosphor as used for the fluorescent filter 4 is formed on an inner peripheral surface of the lamp holder 2 or a nontransparent substrate to convert light scattered from the halogen lamp 1 into light of a desired long wavelength so that light outwardly discharged from the light source may be further increased in intensity.

Thus, when light of the lamp 1 indicated at the solid line (a) in FIG. 1 is treated through the fluorescent filter 4, a component of light having a long wavelength exceeding 550 nm is caused to pass through the filter 4 as indicated at the dotted lines (b) in FIG. 1 and the remaining light component of a wavelength below 550 nm excites the filter to cause it to emit light indicated at the wave line (c) in FIG. 1, which is superposed on the transmitted light (b) and then outwardly discharged through the cover glass 3. Also, light of the lamp impinged on the phosphor layer 5 is outwardly discharged as the sum of a portion (d) of the light of a wavelength above about 550nm reflected on the phosphor layer and light (e) emitted from the phosphor layer 5 excited by a portion of the light of a short wavelength below 550 nm.

Thus, it will be noted that the embodiment shown in FIG. 1 causes a portion of light from the lamp 1 which is interrupted by a conventional filter to be effectively utilized so as to substantially increase the intensity of lightening of the light source.

Figure 2:
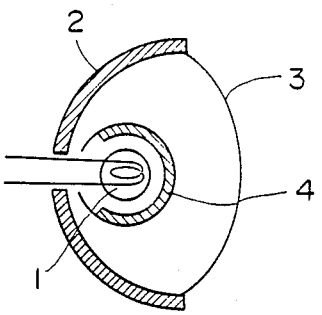
Figure 3:
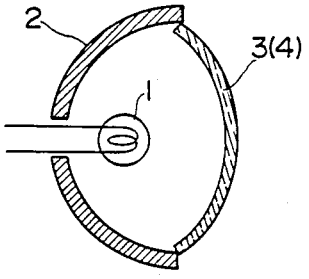
Figure 4:
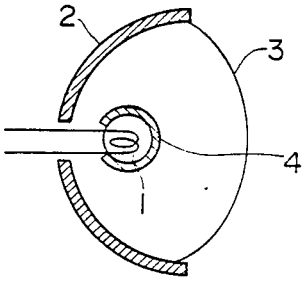

In an embodiment shown in FIG. 2, a fluorescent filter 4 is formed by depositing a phosphor layer on a transparent cover arranged on an outer periphery of a lamp 1. In an embodiment shown in FIG. 3, a fluorescent filter 4 is formed by.depositing a phosphor layer on a cover glass 3 of a lamp holder 2. The phosphor layer may be applied to an inner surface of the cover 3. Alternatively, when the cover 3 is formed of a plastic material, phosphor may be included in the plastic material so that the flourescent filter 3 may comprise the cover 3 formed of such phosphor including plastic material. In an embodiment of FIG. 4, a fluorescent filter 4 is formed by depositing a phosphor layer directly on an outer surface of a lamp 1.

Figure 5:
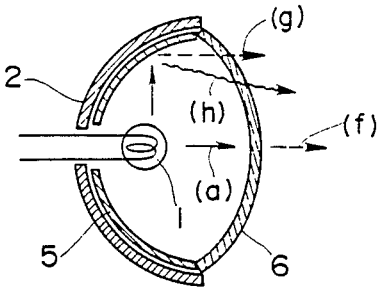

An embodiment of a light source shown in FIG. 5 includes a combination of a fluorescent filter and a conventional filter 6. The fluorescent filter is formed by applying a phosphor layer 5 to an inner surface of a lamp holder 2 and the conventional filter 6 comprises a cover glass. In this embodiment, light (f) of a lamp 1 passing through the filter 6 is outwardly discharged together with light (g) of the lamp 1 reflected on the phosphor layer 5 and light (h) emitted from the phosphor layer 5 due to impingement of a part of light of the lamp on the phosphor layer 5.

As can be seen from the foregoing, in the light source of the present invention, the phosphor layer is provided at a part of the filter arranged adjacent to the light emitting lamp or arranged so as to serve as the reflection layer so that it may be excited by a part of light of the lamp to emit light of a visible region. The phosphor layer transmits light of a wavelength essentially required for lighting and emits light due to the excitation by light of a wavelength which is not required for lighting so that light outwardly discharged from the light source may be increased in intensity.

Thus, the present invention allows light which has been conventionally removed as an unnecessary light component to be effectively utilized for exciting the phosphor layer, to thereby provide a light source highly improved in lightening efficiency. Also, the present invention accomplishes energy saving and can be effectively applied to various kinds of light sources, such as, for example, a fog lamp various auxiliary lamps for an automobile, stage lighting and the like.

While preferred embodiments of the invention have been described with a certain degree of particularity with reference to the drawings, obvious modifications and variations are possible in light of the above teachings. It is therefore to be understood that within the scope of the appended claims, the invention may be practiced otherwise than as specifically described.

What is claimed as new and desired to be secured by Letters Patent of the United States is:

1. A light source comprising:
a lamp;
a lamp holder means for receiving said lamp therein and reflecting light produced from said lamp;
a cover glass for said lamp; and
a filter containing phosphor layer for emitting light of visible region to be excited by said lamp, said filter being arranged to adjacent to said lamp,
wherein said filter allows light to pass in the range of 500–700 nm.

2. The light source as defined in claim 1, wherein said filter containing phosphor is deposited on a light permeable material.

3. The light source as defined in claim 2, wherein said filter containing phosphor is arranged on an outer periphery of said lamp.

4. The light source as defined in claim 2, wherein said filter contain phosphor is arranged between said lamp and said cover glass.

5. The light source as defined in claim 1 further comprising:
a second phosphor layer for emitting light of visible region to be excited by said lamp, said phosphor layer being deposited on an inner peripheral surface of said lamp holder.

6. The light source as defined in claim 1 wherein said filter containing phosphor is deposited on an inner surface of said cover glass.

7. The light source as defined in claim 1 wherein said phosphor filter containing is deposited on an outer surface of said lamp.

8. A light source comprising:
a lamp;
a lamp holder means for receiving said lamp therein and reflecting light produced from said lamp; and
a filter cover glass for said lamp, said filter cover glass containing a phosphor emitting light in the range of 500–700 nm.

9. A light source comprising:
a lamp;
a lamp holder means for receiving said lamp therein and reflecting light produced from said lamp;
a filter cover glass for said lamp having predetermined spectral transmittance characteristics; and
a phosphor layer in direct contact with said filter cover for emitting light in the range of 500–700 nm, said phosphor layer being deposited on an inner peripheral surface of said lamp holder.

* * * * *